United States Patent [19]

Kaneko et al.

[11] 4,349,190

[45] Sep. 14, 1982

[54] SHEET CLASSIFYING SYSTEM HAVING DEFLECTING DEVICE

[75] Inventors: Tamaki Kaneko, Fujisawa; Kunio Hibi; Sunao Ikeda, both of Yokohama; Tugio Okuzawa, Tokyo; Yohtaro Kakitani; Hideo Kikuchi, both of Yokohama, all of Japan

[73] Assignee: Ricoh Co., Ltd., Japan

[21] Appl. No.: 190,063

[22] Filed: Sep. 23, 1980

[30] Foreign Application Priority Data

| | | | |
|---|---|---|---|
| Sep. 29, 1979 | [JP] | Japan | 54-126004 |
| Jan. 17, 1980 | [JP] | Japan | 55-3066 |
| Feb. 29, 1980 | [JP] | Japan | 55-27007[U] |
| Feb. 29, 1980 | [JP] | Japan | 55-27008[U] |

[51] Int. Cl.[3] ..... B65H 29/54

[52] U.S. Cl. ..... 271/297; 271/305; 271/194

[58] Field of Search ..... 271/296, 297, 305, 194

[56] References Cited

U.S. PATENT DOCUMENTS

| | | | |
|---|---|---|---|
| 2,661,209 | 12/1953 | McGalliard | 271/297 |
| 4,026,540 | 5/1977 | Lawrence | 271/297 X |

*Primary Examiner*—Richard A. Schacher
*Attorney, Agent, or Firm*—McGlew and Tuttle

[57] ABSTRACT

A system for successively distributing one sheet after another to sheet receiving bins having a sheet guide device including conveyor belts and having sheet separating claws and a guiding device. The guiding device includes a contacting member successively brought into engagement with the sheet separating claws of a plurality of layers as the guiding device moves downwardly, to move the claws to an operative position in which the claws separates a sheet from the conveyor belts. The contacting member is moved to a position in which it is prevented from engaging the claws when the guiding device is moved upwardly during operation of the system. The sheet separated by the claws from the conveyor belts is moved to each bin along lower and upper guide plates while having its curl taken care of by a rod-shaped guide. The sheet guide device can be pivotally moved relative to a main body of the system, and the guiding device can be pivotally moved relative to the sheet guide device. The upper guide plate movable relative to the lower guide plates to open or close a sheet passage defined thereby.

5 Claims, 24 Drawing Figures

SHEET CLASSIFYING SYSTEM HAVING DEFLECTING DEVICE

BACKGROUND OF THE INVENTION

This invention relates to a sheet classifying system comprising a plurality of sheet receiving bins arranged vertically and spaced from one another a predetermined distance, sheet guide means including sheet conveyor belts mounted vertically along the inlet end of the bins, a plurality of sets of sheet separating claws disposed along the sheet conveyor belts and each being positioned against one of the sheet receiving bins, and a guiding unit moved by the sheet guide means vertically along the sheet conveyor belts, movement of the guiding unit bringing the sheet separating claws successively into an operative position, to thereby deflect the sheets transported by the sheet conveyor belts toward the predetermined sheet receiving bins.

In this type of sheet classifying system, which may be either a collator or a sorter, the sets of the sheet separating claws disposed in positions corresponding to the respective sheet receiving bins are normally moved to positions in which they do not interfere with the transportation of sheets by the sheet conveyor belts. Only a set of the sheet separating claw which is disposed in the position in which a sheet is to be deflected has its cam surface at the back thereof pushed by a contacting member attached to the guiding device, so that the set of the sheet separating claws projects beyond or into the surface of the conveyor belts to move to the operative position.

FIGS. 1 and 2 show sheet separating claws and the engaging or contacting member of the prior art. In the system shown in FIG. 1, sheet separating claws 62 are each bifurcated and include a sheet guide piece 62*b* and a cam surface piece 62*a*. Each sheet separating claw 62 is normally prevented by its own weight from projecting beyond the surface of a conveyor belt 7. A push pin 66 coupled to a solenoid 49 mounted on a guiding device 8 is disposed in a solid line position as shown in FIG. 1 in which it presses against a set of the sheet separating claws 62 when the guiding device 8 moves downwardly. As the guiding device 8 moves downwardly, the cam surface pieces 62*a* of the sheet separating claws 62 are successively pushed by the push pin 66 to cause the guide pieces 62*b* to project beyond the surface of the conveyor belts 7, so as to deflect sheets along the projecting cam surface pieces 62*a*. When the guiding device 8 moves upwardly, the push pin 66 is moved by the action of the solenoid 49 to a broken line position in which it is spaced apart from the sheet separating claws 62. Thus when the guiding device moves upwardly, the sheet separating claws 62 disposed in normal positions are not contacted by the push pin 66.

For effecting maintenance and repair, however, it often happens that the guiding device should be manually moved up and down by disconnecting it from the power source. With the sheet separating claws 62 each being bifurcated, it is necessary to move the push pin 66 to a position in which it is spaced apart from the cam surface pieces 62*a* of the claws 62 when the guiding device is moved upwardly. Otherwise, the push pin 66 would be caught between the cam surface piece 62*a* and the guide piece 62*b* of a claw 62 and prevent upward movement of the guiding device. In normal operation of the sheet classifying system, the mechanism for moving the guiding device 8 upwardly is actuated when the solenoid 49 for moving the guiding device 8 upwardly is not energized. Thus, the solenoid 49 for moving the device 8 upwardly is energized during the time the guiding device 8 is being moved downwardly for performing collating or sorting. The period of time during which the guiding device 8 is moving downwardly is longer than the period of time during which it is moving upwardly, so that this arrangement causes unnecessary consumption of energy and an undesirable rise in temperature in the machine.

FIG. 2 shows another system of the prior art in which a cam plate 64 is mounted on a shaft 60 supporting a set of separating plates 63 in such a manner that the cam plate 64 and separating plates 63 are separate entities and directed in opposite directions. The cam plate 64 is shaped such that when an engaging pin 66 moves both downwardly and upwardly with the guiding device 8 the cam plate 64 is smoothly engaged by the engaging pin 66 to move the sheet separating claw 62 to an operative position (solid line position), without the engaging pin 66 secured to a guiding device side plate 18 catching against the cam plate 64. However, when moved upwardly, the pin 66 strikes the cam plates 64 successively at short intervals, thereby causing noise production. Moreover, application of the force of impact results in a short service life of the parts.

At least one guide plate is generally mounted in the path of travel of sheets for guiding the same in a system of moving sheets. When the sheets guided by the guide plate are heated as is the case with the sheets processed in a copying apparatus, the sheets tend to curl at the edge and the edge portions of the sheets tend to clear the path of travel, thereby causing sheet jam.

In a sheet classifying system of the prior art, when trouble occurs during a sheet classifying operation, the cover is removed by loosening the screws and the machine parts involved in the problem are disassembled for inspection and repair. After necessary repairs have been completed, the machine parts are assembled again. This process is time consuming and labor intensive requiring many man-hours.

SUMMARY OF THE INVENTION

An object of the invention is to provide a sheet classifying system comprising a mechanism which is operative to move the sheet separating claws successively into an operative position during downward movement of the guiding device and to move the engaging member to an inoperative position in which it is refrained from coming into contact with the cam for actuating each of the sheet separating claws during its upward movement, the mechanism being also operative to enable the guiding device to smoothly move upwardly by pushing the cams when the engaging member is not moved to the inoperative position.

Another object is to provide a sheet classifying system which enables maintenance and repair to be effected readily and permits trouble to be removed with ease, so that the time required for maintenance and repair of a mechanical breakdown can be shortened.

Still another object is to provide a sheet classifying system including a sheet guide device enabling sheets with edge curl to be conveyed without causing a sheet jam to occur by means of a simple mechanism.

A further object is to provide a sheet classifying system including a sheet guide device enabling sheets to be readily moved by a simple mechanism even of a sheet jam occurs.

According to the invention, there is provided a sheet classifying system comprising a plurality of sets of sheet separating claws, a plurality of sheet separating claw displacing cams, at least one cam being associated with one set of sheet separating claws for movement as a unit with the claws, an engaging member mounted in a guiding device for engagement with said sheet separating claw displacing cams for moving the sheet displacement claws between an operative position and an inoperative position, sheet separating claw restoring means normally urging the sheet separating claws to return to the inoperative position, and a solenoid for actuating a mechanism for moving the guiding device upwardly, the engaging member being usually maintained in a position in which it engages the sheet separating claw displacing cam and the solenoid being operative to actuate the mechanism for moving the guiding device upwardly and keep the engaging member in a positione in which it is released from engagement with the sheet separating claw displacing cam.

Additional and other objects, features and advantages of the invention will be apparent from the description set forth hereinafter when considered in conjunction with the accompanying drawings.

DESCRIPTION OF THE PREFERRED EMBODIMENTS

Figure 1:
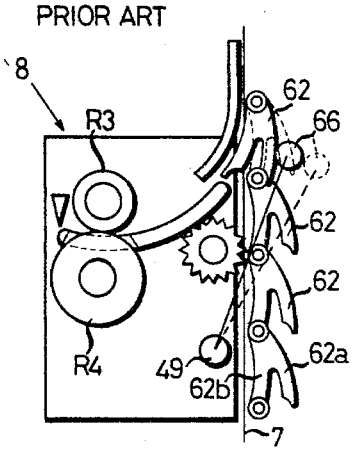
FIG.1 PRIOR ART
FIGS. 1 and 2 are schematic views of sheet separating claws and the engaging member engageable with the claws for causing their displacement of a sheet classifying system of the prior art having a guiding device, showing their shapes and their positional relation.
Figure 2:
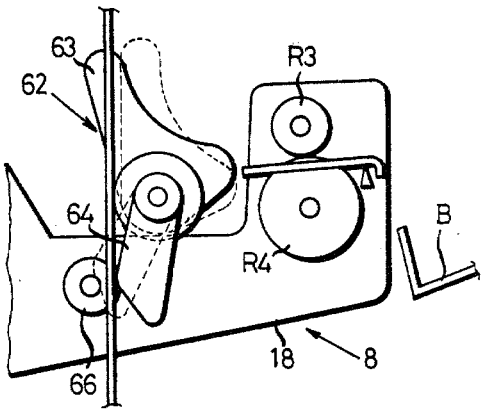
FIG.2 PRIOR ART
Figure 3:
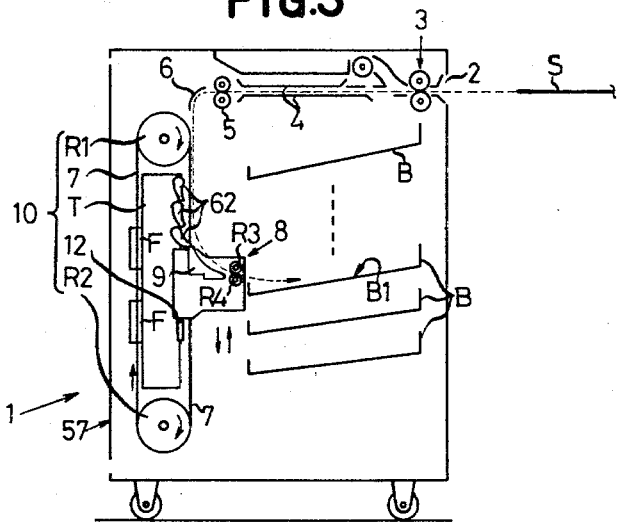
FIG. 3 is a schematic view of the sheet classifying system comprising one embodiment of the invention.

A first embodiment will be described by referring to FIGS. 3–12. In FIG. 3, a sheet classifying system 1 comprises a plurality of sheet receiving bins B arranged vertically in a plurality of layers with a predetermined spacing, a sheet guide means or device 10 including conveyor belts 7 disposed vertically along the inlet end of the bins B, a plurality of sets of sheet separating claws 62 each located in a position corresponding to one of the sheet receiving bins B, and a guiding device 8 vertically movable along the conveyor belts 7 by the action of the sheet guide device 10.

The character letter S designates a sheet ejected by a copying apparatus, or a printing apparatus, and having an image copied or printed thereon. The sheet S is delivered to the sheet classifying system 1 by sheet feeding means, not shown.

The sheet S introduced into the sheet classifying system 1, through a sheet inlet 2, is fed substantially horizontally as indicated by a broken line by a pair of feed rollers 3, a pair of guide plates 4 and a pair of supply rollers 5. In this specification, the sheet classifying system 1 may include a collator, a sorter and the like. The sheet S moving horizontally has the direction of its movement changed by the direction changing plate 6 to a vertical direction and is attracted to the conveyor belts 7, mounted endlessly in a vertical direction, for supplying the sheet S to the guiding device 8. Then the sheet S is deflected by a set of separating claws 62 selectively moved to an operative position and a set of guide plates 9 in the guiding device 8, to move along the curved surface of the plates 9 to a pair of ejecting rollers $R_3$ and $R_4$ which ejects the sheet S on to a sheet receiving surface $B_1$ of one of the bins B.

Each of the conveyor belts 7 is supported by pulleys $R_1$ and $R_2$ constituting the sheet guide means or device 10. A vacuum tank T extending substantially along the entire zone in which the sheet receiving bins B are disposed in a vertical direction also constitutes the sheet guide device 10.

The guiding device 8 is guided by a shaft 12 for movement in a vertical direction for distributing the sheets S to the bins B. The shaft 12 also constitutes a part of the sheet guide device 10.

Figure 4:
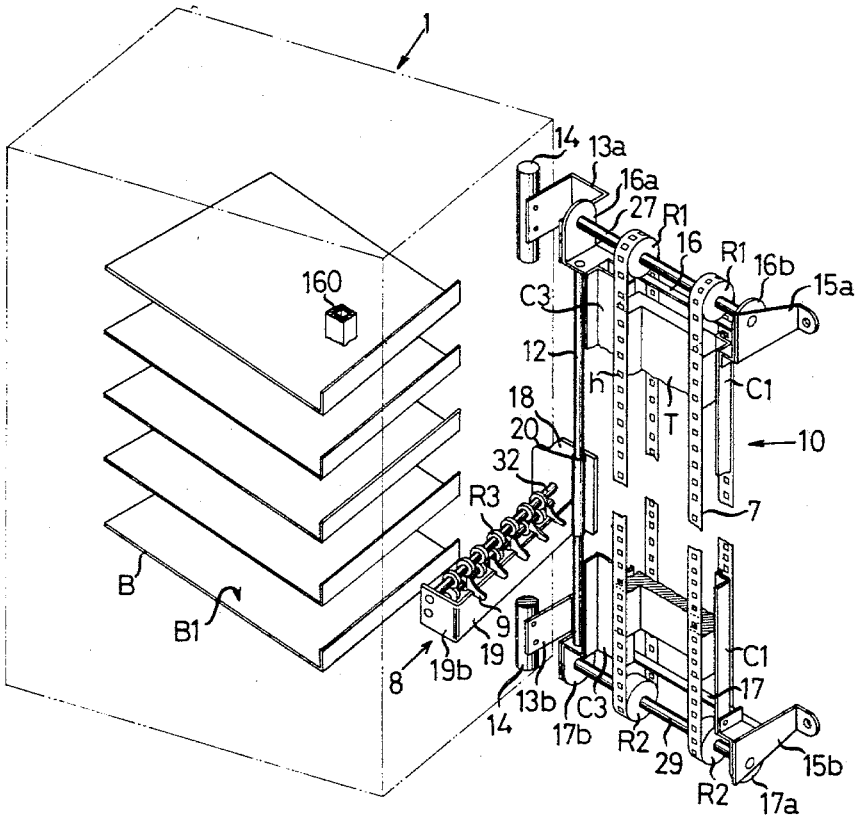
FIG. 4 is a perspective view of the essential portions of the sheet classifying system shown in FIG. 3 in which the sheet guide device and the guiding device are exposed for maintenance.

Referring to FIG. 4, substantially U-shaped bent members 13*a* and 13*b* are each attached to one side of the sheet guide device 10 and each have secured thereto a vertically extending shaft 14 rotatably supported by a main body of the sheet classifying system 1. Thus, the sheet guide device 10 can be moved in pivotal movement about the shafts 14. In FIG. 4, the sheet guide device 10 is shown in an open position to which it has pivotally moved about the shafts 14. Meanwhile, substantially L-shaped bent members 15*a* and 15*b* are each attached to the other side of the sheet guide device 10 and screwed to a main frame 160 of the system 10 when the latter is in a closed position, so that the sheets can be classified as described hereinabove by referring to FIG. 3.

The bent members 13*a* and 15*a* are each secured to one of bent portions 16*a* and 16*b* at opposite ends of a support member 16 at an upper end of the guide means 10. Likewise, the bent members 13*b* and 15*b* are each secured to one of bent portions 17*a* and 17*b* at opposite ends of a support member 17 at a lower end of the guide device 10. The shaft 12 of the guiding device 8 is secured to the support members 16 and 17 near the bent portions 16*a* and 17*b*. The guiding device 8 comprises a side plate 18, a mounting plate 19 secured at one end thereof to the side plate 18 and arranged longitudinally with the support member 16, and other parts secured to the side plate 18 and mounting plate 19. A bearing 20 is mounted on the mounting plate 19 in a portion thereof near the side plate 18 for slidably journalling the shaft 12.

Figure 5:
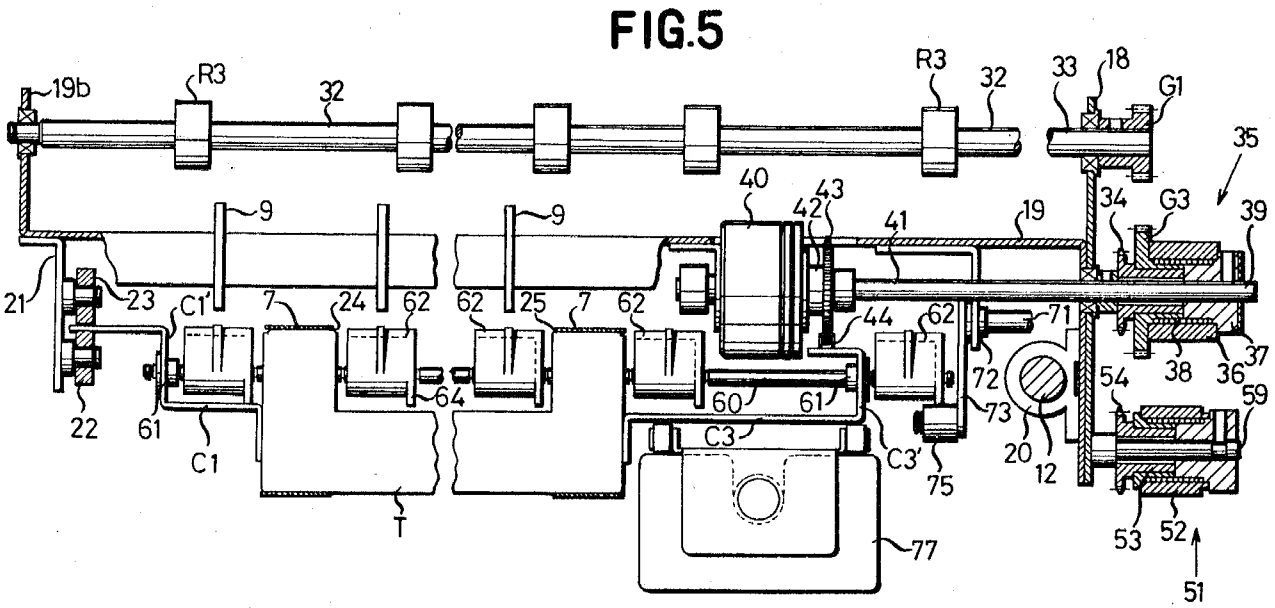
FIG. 5 is a plan view, with certain parts being cut out and shown in section, of the sheet guide device and guiding device.

Referring to FIGS. 4 and 5, a bracket 21 is detachably attached to the other end of the mounting plate 19 as shown on the left side in FIG. 5 to support a pair of rollers 22 and 23 through shafts. When the bracket 21 is attached to the mounting plate 19, the rollers 22 and 23 hold therebetween edges of one channel $C_1$ of two channels $C_1$ and $C_3$ secured between the two support members 16 and 17.

The rollers 22 and 23 which are maintained in light contact with the channel $C_1$ perform, along with the bearing 20, the function of guiding the guiding device 8 as the latter moves vertically.

By utilizing the two channels $C_1$ and $C_3$ secured between the upper and lower support members 16 and 17, the vacuum tank T is secured between the support members 16 and 17.

Figure 6:
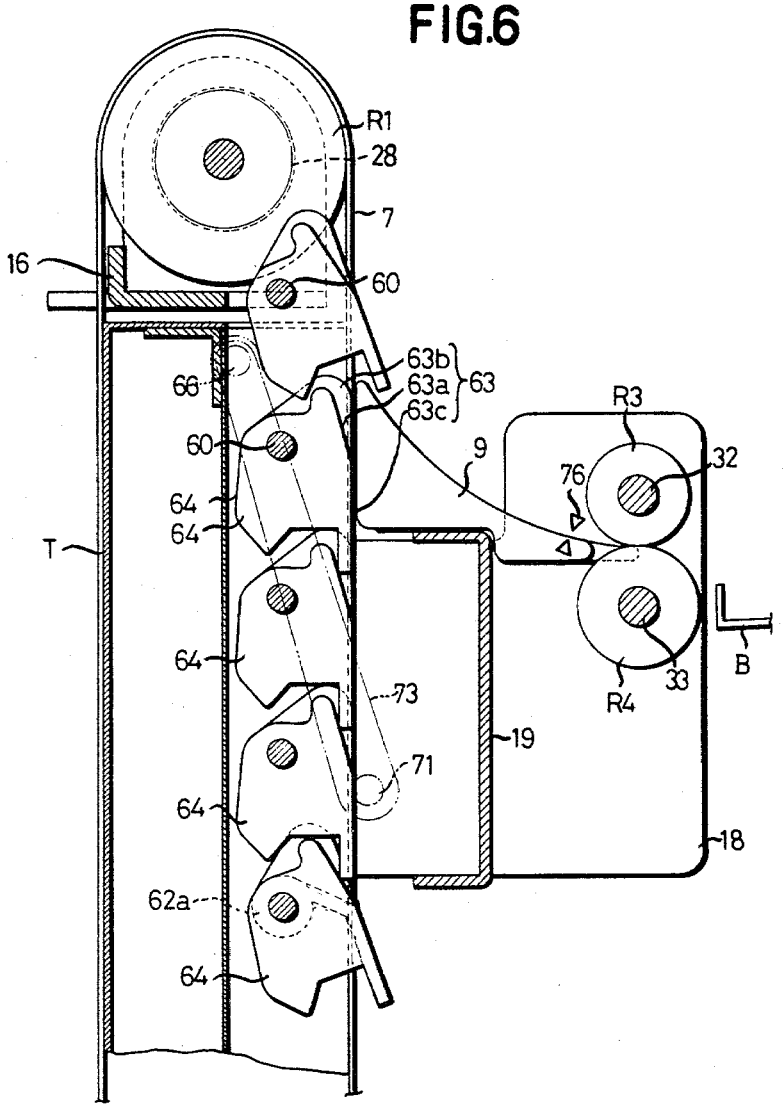
FIG. 6 is a view showing in detail the positional relations of the conveyor belt and sheet separating claws, the guide plate and ejecting rollers on the side of the guiding device, and the ejection rollers and the bins, shown in FIG. 3.
Figure 7:
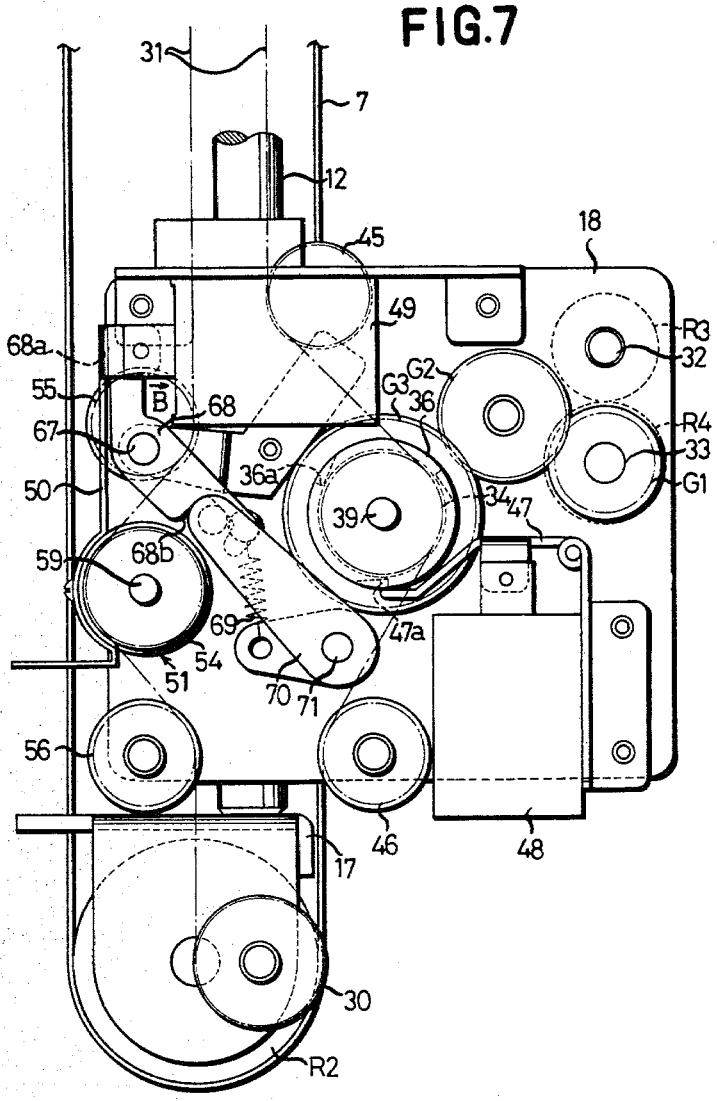
FIG. 7 shows the drive mechanism for the guiding device, as viewed from outside the side plate.
Figure 8:
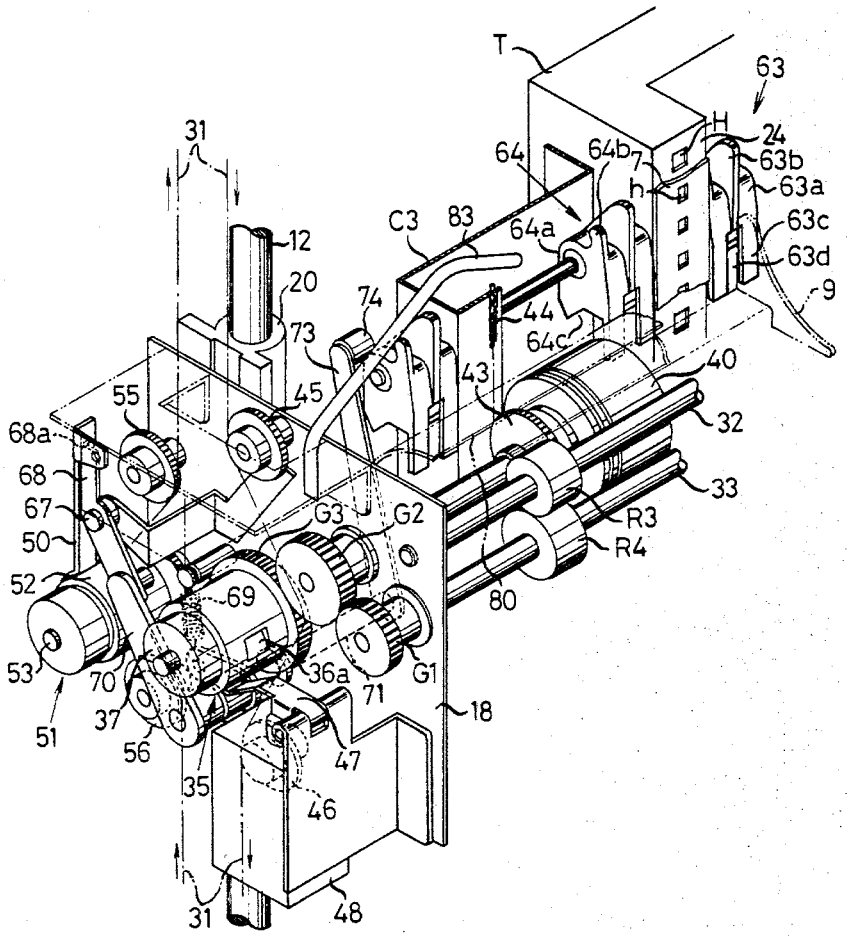
FIG. 8 is a perspective view of a part inside and outside the side plate of the guiding device.
Figure 11:
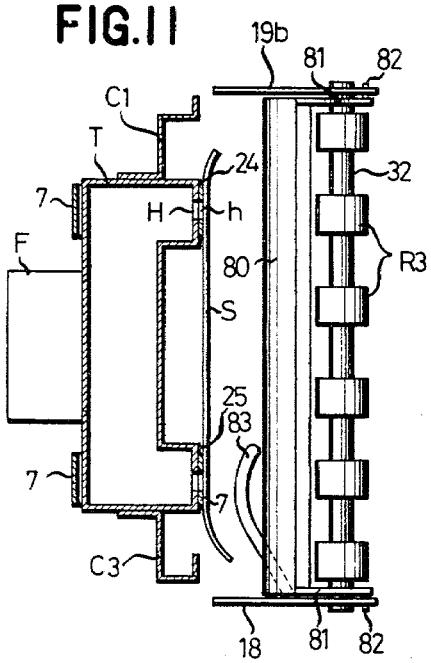
FIG. 11 is a sectional view taken along the line XI—XI in FIG. 9.
Figure 12:
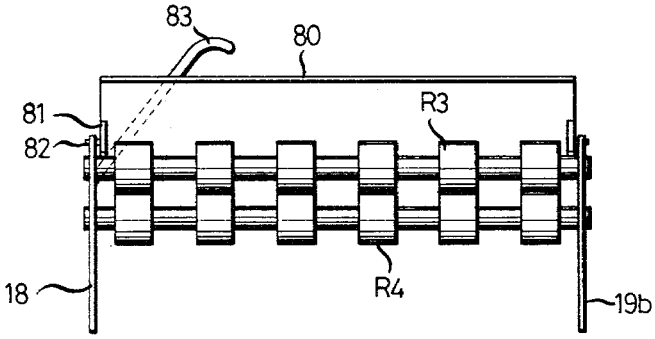
FIG. 12 is a schematic view of the guiding device shown in FIG. 9, as viewed from the side of the bins.

Referring to FIGS. 5, 6 and 7, the vacuum tank T is formed with two vertically extending projecting surfaces 24 and 25 (See FIGS. 8 and 11). The projecting surfaces 24 and 25 have a width substantially equal to that of the conveyor belts 7 and formed with a multiplicity of holes H arranged vertically (See FIGS. 4, 9 and 11). The conveyor belts 7 are trained over the pulleys $R_1$ and $R_2$ so as to move endlessly while being maintained in contact with the projecting surfaces 24 and 25 of the vacuum tank T. Thus the vacuum tank T is disposed between the upwardly and downwardly moving runs of the conveyor belts 7 which are also formed with holes h along their entire lengths. The vacuum tank T has attached to its back an air drawing fan F for drawing air through the holes H during operation of the sheet classifying system 1 (See FIGS. 3, 9 and 11). When the air is drawn, the conveyor belts 7 are moved in such a manner that the runs of the belts 7 in contact with the projecting surfaces 24 and 25 move downwardly, so that the air is drawn through the holes h in the conveyor belts 7 and the holes H on the projecting surfaces. Thus the sheet S having the direction of its movement changed by the direction changing plate 6 is intimately attached to the surfaces of the conveyor belts 7, to be moved downwardly as the conveyor belts 7 move downwardly without being dislodged therefrom to the guiding device 8.

The movement of the conveyor belts 7 is obtained by rotation of the pulleys $R_1$ and $R_2$. Pulleys $R_1$ rotate along with a shaft 27 journalled between the bent portions 16*a* and 16*b* of the upper support member 16 and having secured to one end thereof extending from the bent portion 16*a* an upper sprocket wheel 28 (See FIG. 6). Pulleys $R_2$ are rotatably supported by a shaft 29 journalled between the bent portions 17*a* and 17*b* of the lower support member 17. A lower sprocket wheel 30 (See FIG. 7) is rotatably supported on the bent portion 17*b* and in a position juxtaposed against the upper sprocket wheel 28. A chain 31 (See FIG. 8) is trained over the two sprocket wheels, and the upper sprocket wheel 28 is driven by power transmitting means, not shown, to move the conveyor belts 7. The conveyor belts 7 formed of resilient material, such as rubber, is maintained in contact with the pulleys $R_1$ and $R_2$ with a suitable degree of pressing force, to avoid irregularities in their endless movement due to slip or other trouble and facilitate detaching of the belts 7 when maintenance is effected.

The chain 31 trained over the upper and lower sprocket wheels 28 and 30 is moved at all times during operation of the sheet classifying system 1. Movement of the chain 31 is utilized for moving the guiding device 8 vertically and the feeding of the sheet S after being deflected by the guiding device 8.

Referring to FIGS. 5 and 6, sheet separating claw shafts 60 extending parallel to the pulley shafts 27 and 29 are provided in number corresponding to the number of the sheet receiving bins B. The sheet separating claw shafts 60 are rotatably supported by bearings 61 secured to a side wall $C_{1'}$ of the channel $C_1$ and a side wall $C_{3'}$ of the channel $C_3$. Each of the shafts 60 supports a set of sheet separating claws 62. Thus, a plurality of sets of sheet separating claws 62 are disposed along the inner side of the conveyor belts 7 driven by the drive pulley $R_1$ and each set is disposed at a height corresponding to one of the vertically arranged bins B.

Referring to FIGS. 6 and 8, each of the sheet separating claws 62 is formed of a synthetic resinous material and includes a claw plate 63 and a cam plate 64 formed integrally with each other. With the sheet separating claw 62 being in an inoperative position (the second to fourth claws, i.e., the three centered claws, as seen from above in FIG. 6 are each in an inoperative position), the claw plate 63 includes an upper surface 63*a* extending from a hub 62*a* of the claw 62 obliquely downwardly to the sheet conveying surfaces of the conveyor belts 7, a plate-like projection 63*b* disposed in the upper surface 63*a* and extending perpendicular to the shaft 60 near the center of the width of the claw plate 63, a planar sheet guide surface 63*c* continuous with the upper surface 63*a* and corresponding in position to the sheet conveying surfaces of the conveyor belts 7 and extending further downwardly, and a cutout 63*d* formed in the center of the planar sheet guide surface 63*c*. Meanwhile the cam plate 64 is located at one end or both ends of the claw plate 62 as viewed in the direction of the shaft 60, so that the cam plate 64 and the planar sheet guide surface 63c of the claw plate 63 are perpendicular to each other. The cam plate 64 has a cam surface 64a on a side opposite to the side at which the planar sheet guide surface 63c is located. The cam plate 64 is formed at its upper side with a projection 64b smaller than the projection 63b of the claw plate 63 and at its lower edge with a cutout 64c of a relatively large width. Thus, the separating claw 62 has a slightly larger weightness on the side of the sheet conveying surfaces of the conveyor belts 7 than on the other side of the conveyor belts 7 with respect to the shaft 60. As a result, the sheet separating claw 62 is urged by its own weight to slightly rotate clockwise from the position in which the second to fourth claws 62 from above in FIG. 6 are disposed. However, since the claw plate 63 of one sheet separating claw 62 strikes at its lower end the upper surface 63a of another sheet separating claw 62 disposed immediately below it, all the sheet separating claws 62 are normally maintained in a condition in which the planar sheet guide surfaces 63c of the claw plates 63 are disposed in a position corresponding to that of the sheet conveying surfaces of the conveyor belts 7. When the center of gravity of each sheet separating claw 62 is disposed on the side of the sheet conveying surfaces of the conveyor belts 7 rather than on the side of the shaft 60, one of the sheet separating claws 62 supported by one shaft 60 is pulled by a return spring mounted between the lower portion of its cam plate 64 and the channels $C_1$ (or $C_3$). In any case, the planar sheet guide surface 63c of each claw plate 63 substantially corresponds in position to the sheet conveying surfaces of the conveyor belts 7, and their surfaces are continuous with each other to avoid bending of the downwardly fed sheet S by keeping the sheet flat.

The cutout 64c formed in the cam plate 64 of one sheet separating claw 62 receives therein the projection 64d of the cam plate 64 of another sheet separating claw 62 disposed immediately below it, so that the claws 62 disposed in the front and rear ensure that they rotate correctly without any trouble. More specifically, when one sheet separating claw rotates from an inoperative position to an operative position, another sheet separating claw 62 disposed immediately above or below it is positively moved to an inoperative position because the cutout 64c of the cam plate 64 of the former separating claw 62 is brought into engagement with the projection 64b of the cam plate 64 of the latter separating claw 62. Stated differently, the cam surface 64a of each claw 62 is shaped such that when the push pin 66 of the guiding device 8 moves both upwardly and downwardly together with the guiding device 8 the push pin 66 can smoothly engage one cam surface 64a without any interference.

As shown in FIGS. 5 and 6, the guide plates 9 of the guiding device 8 are mounted on the mounting plate 19 in positions corresponding to either the cutouts 63d or the sides of the sheet separating claws 62. The mounting plate 19 is bent at its end portion opposite the side plate 18 to provide a bent portion 19b, and two shafts 32 and 33 are supported parallel to each other by the bend portion 19b and the side plate 18 for rotation. The shaft 32 has a plurality of ejection rollers $R_3$ secured thereto, and the shaft 33 also has a plurality of ejection rollers $R_4$ secured thereto. The shaft 33 drives the ejection rollers $R_3$ and $R_4$.

The guiding device 8 moves downwardly from one bin B to the next bin B. In this downward movement of the guiding device 8, the push pin 66 is brought into contact with a portion of the cam surface 64a near the shaft 60, and slides downwardly along the cam surface 64a as the downward movement of the guiding device 8 progresses. Thus, the sheet separating claw 62 is pushed by the push pin 66 and rotates counterclockwise about the shaft 60 in FIG. 6, so that the when the guiding device 8 stops in a predetermined position corresponding to the bin B the sheet separating claw 62 is disposed in a position (operative position) in which the sheet guide surface 63c projects beyond the sheet conveying surfaces of the conveyor belts 7. At this time, the guide plates 9 partly enter the cutout 63d in the claw plate 63, to cause the sheet separating claw 62 to tilt until the forward end of the claw plate 63 is disposed above the vertical piece 9b or the guide plate 9. As a result, a guide surface leading from the sheet guide surface 63d of the sheet separating claw 62 to the bin B through the guide plates 9 and the ejection rollers $R_3$ and $R_4$ secured to the guiding device 8 is formed for the sheet S.

Figure 9:
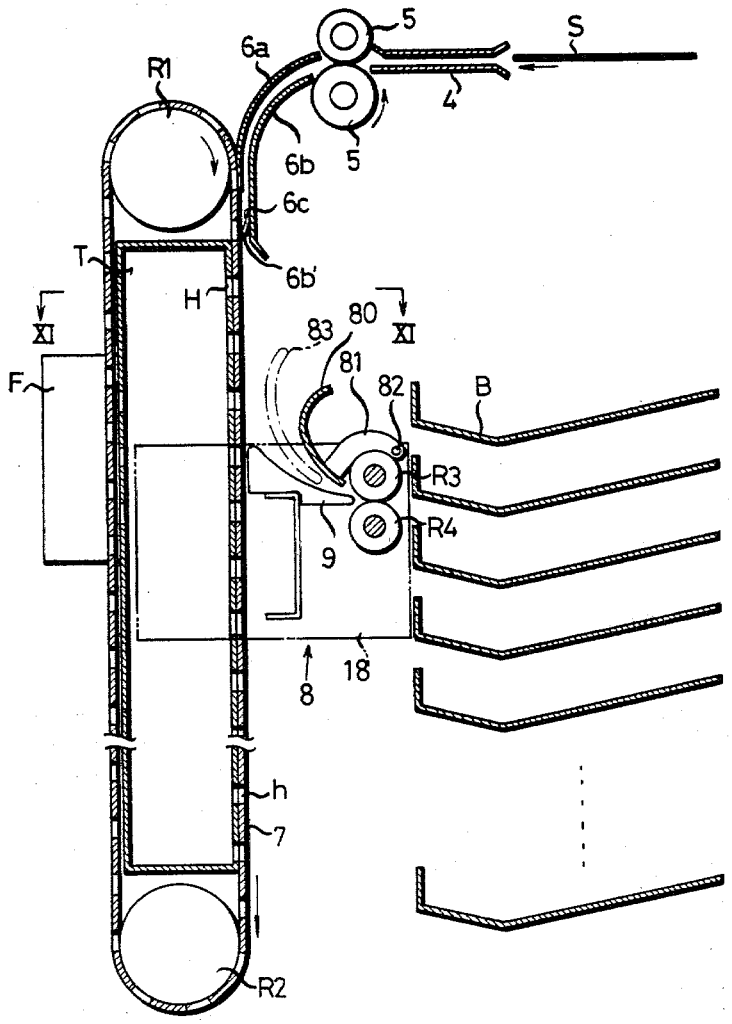
FIG. 9 is a view showing a part of the system shown in FIG. 3 more in detail by removing the sheet separating claws.
Figure 10:
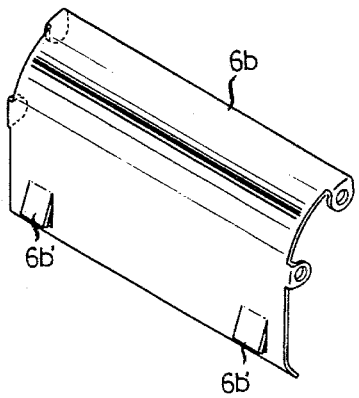
FIG. 10 is a perspective view of the lower guide members of the direction changing plate.

Referring to FIG. 9, the direction changing plate 6 referred to hereinabove includes two guide plates 6a and 6b mounted between the pair of feed rollers 5 and the conveyor belts 7 (at the upper end of the vacuum tank T). Moreover specifically, the guide plates 6a and 6b guide the sheet S fed by the feed rollers 5 to the conveyor belts 7 associated with the vacuum tank T. As viewed from the side, the guide plates 6a and 6b are curved, and the guide plate 6b disposed at the lower level is formed at its lower end portion with two bent pieces 6b' and 6b' disposed on the right and left sides (See FIG. 10). The bent pieces 6b' are bent in the direction of the guide plate 6a to form an inclined portion 6c in the passage defined between the guide plates 6a and 6b which becomes successively narrower in going toward the conveyor belts 7.

An upper guide plate 80 is mounted anterior to the ejection rollers $R_3$ and $R_4$ to cooperate with the guide plates 9, for guiding the sheet S moving through the sheet separating claws 62, not shown in FIG. 9, and along the surface of the guide plate 9 to the ejection rollers $R_3$ and $R_4$. The sheet conveying passage defined by the sheet guide surface formed by the sheet separating claws 62 and guide plates 9 and the upper guide plate 80 is curved such that it is wide in its inlet portion but gradually becomes narrower in going toward the ejection rollers $R_3$ and $R_4$. Arms 81 extending from opposite sides of the base of the upper guide plate 80 and straddling the ejection rollers $R_3$ and $R_4$ are pivotally supported by pins 82 and 82 connected to the side plate 18 and the bent portion 19b of the mounting plate 19 (See FIGS. 9 and 11). Thus, the upper guide plate 80 is capable of opening and closing the conveying passage for the sheet S.

A curved rod-shaped guide 83 mounted at its one end to the side plate 18 is interposed between the lower guide plates 9 and the upper guide plate 80. The curved rod-shaped guide 83 is short in length and does not reach midway between the side plate 18 and the bent portion 19a (See FIGS. 11 and 12). The rod-shaped guide 83 is curved such that it projects toward the conveyor belts 7 in its central portion and is spaced apart therefrom at its end as viewed in the direction of movement of the sheet S (See FIGS. 8 and 11) or its central portion is disposed at a higher level and its mounting end is disposed at a lower level as seen from other direction (See FIG. 12).

In this construction, the sheet S as from an image fixing section of a copying apparatus is fed by the feed rollers 5 to the conveyor belts 7. The sheet S heated for fixing the image in the copying apparatus tends to curl. However, the provision of the guide plates 6*a* and 6*b* for guiding the sheet S from the feed rollers 5 to the conveyor belts 7 has the effect of enabling the sheet S to be transferred to the conveyor belts 7 without trouble even if the sheet S is curled. More specifically, the inclined narrow portion 6*c* of the sheet passage has a width of about 2 mm because of the bent pieces 6*b'* projecting into the passage from the lower guide 6*b*, so that the sheet S is held down at opposite sides thereof by the bent pieces 6*b'* and passed on to the conveyor belts 7 without causing a sheet jam. Since the sheet S is planar when it passes through the narrow portion 6*c* of the sheet passage at its lower end portion, the sheet S can be positively attracted to the conveyor belts 7 by the action of the vacuum tank T.

The sheet S conveyed by the conveyor belts 7 is separated from the conveyor belts 7 by the sheet separating claws 62 disposed in the operative position and deflected by the guide plates 9 and 80 toward the predetermined bin B. At this time, the sheet S tends to develop a curl at its edge portion extending outwardly of the vacuum tank T. When this is the case, the sheet S is guided while its edge portion is spaced apart from the surface of the guide plates 9, so that a sheet jam tends to occur. However, the provision of the curved rod-shaped guide 83 has the effect of eliminating this problem. More specifically, when the sheet S has a curl at its edge portion, its edge portion tends to warp as shown in FIG. 11. However, with the curved rod-shaped guide 83 in position, the center of the leading end portion of the sheet S contacts the forward end of the guide 83, and then slides toward the end portion of the guide 83 while correcting the curl of the sheet S. In this way, the curl of the sheet S is corrected as the sheet S is moved along the curved rod-shaped guide 83 to the ejection rollers $R_3$ and $R_4$, so that the occurrence of a sheet jam can be avoided. Even if a sheet jam occurs, the sheet S can be readily withdrawn. Since the upper guide plate 80 can open and close the sheet passage, the sheet S stuck on the passage can be readily removed by moving the upper guide plate 80 to a position in which it opens the sheet passage. Although the curved rod-shaped guide 83 is interposed between the guide plates 9 and the upper guide plate 80, the guide 83 is mounted on the side plate 18 and disposed in the rearward position so that it does not interfere with the operation of removing the sheet S from the sheet passage.

Referring to FIGS. 5, 7 and 8, shaft 33 has mounted in its portion extending outwardly of the side plate 18 a gear $G_1$ in meshing engagement with an intermediate gear $G_2$ supported by the side plate 18. The intermediate gear $G_2$ is in meshing engagement with a drive gear $G_3$ which, as shown in FIG. 5, the drive gear $G_3$ is substantially integral with a drive sprocket wheel 34 and rotatable relative to a sleeve 36 of a spring clutch 35. The drive gear $G_3$ includes a sleeve of the same diameter as the sleeve of a transmitting member 37, and a spring 38 is trained over the two sleeves. The spring 38 is secured at one end thereof to the sleeve 36 and at the other end thereof to the transmitting member 37. The transmitting member 37 is secured to an output shaft 39 rotatable relative to the drive sprocket wheel 34 and drive gear $G_3$. The output shaft 39 is connected to an input shaft 41 of an electromagnetic clutch 40 mounted on the mounting plate 19 and having an output shaft 42 having a sprocket 43 secured thereto. The channel $C_3$ has secured thereto a chain 44 for moving the guiding device 8 therealong, with the sprocket 43 being in meshing engagement with the chain 44 (See FIG. 5).

Referring to FIGS. 7 and 8 again, idle sprocket wheels 45 and 46 are mounted on the side plate 18 and disposed above and below the drive sprocket wheel 34 respectively. As shown, the chain 31 has its lower run trained over the idle sprocket wheel 45, drive sprocket wheel 34 and idle sprocket wheel 46 in the indicated order. During operation of the sheet classifying system 1, the drive gear $G_3$ rotates clockwise in FIG. 7 together with drive sprocket 34 at all times.

The sleeve 36 is formed on its outer circumferential surface with link engaging grooves 36*a* which are n in number each disposed in one of positions obtained by dividing the outer circumference into n parts. A link 47 includes a forward end 47*a* which is brought into an out of engagement with one of the engaging grooves 36*a* as shown in FIG. 7. Control of the forward end 47*a* of the link 47 brought into and out of engagement with one of the engaging grooves 36*a* is effected by means of a solenoid 48 mounted on the side plate 18. When the solenoid 48 is deenergized, the forward end 47*a* of the link 47 is brought into engagement with one of the engaging grooves 36*a* by the action of a spring, not shown, in the solenoid 48, to prevent the sleeve 36 from rotating. Conversely, when the solenoid 48 is energized, a plunger of the solenoid 48 is moved downwardly against the biasing force of the spring, not shown, in the solenoid 48, so that the forward end 47*a* of the link 47 is brought out of engagement with the link engaging groove 36*a* of the sleeve 36 to allow the sleeve 36 to freely rotate. When the sleeve 36 rotates in the same direction as the drive gear $G_3$ rotates as shown in FIG. 7 (clockwise) or when the solenoid 48 is energized, the spring clutch 35 is engaged as the spring 38 is tightened, to transmit power from the drive gear $G_3$ to the output shaft 39 through the spring 38 and transmitting member 37. As the electromagnetic clutch 40 is engaged, rotation of the drive sprocket wheel 34 is transmitted to the sprocket 43. Since the sprocket 43 is in meshing engagement with the chain 44, the guiding device 8 begins to move downwardly as guided by the guide shaft 12 and channel $C_3$ along the chain 44 secured to the channel $C_3$. Downward movement of the guiding device 8 can be interrupted by de-energizing the solenoid 48. This brings the forward end 47*a* of the ling 47 into engagement with one of the engaging grooves 46*a* of the sleeve 36 to interrupt rotation of the sleeve 36, so that the spring clutch 35 is brought to a so-called slip condition. Thus transmission of power from the drive gear $G_3$ to the output shaft 39 is interrupted to thereby interrupt downward movement of the guiding device 8. By energizing and de-energizing the solenoid 48, it is possible to obtain intermittent downward movement of the guiding device 8, so that movement of the guiding device 8 can be correctly controlled to allow the device 8 to stop in positions corresponding to the bins B in a plurality of layers. The spacing between the adjacent link engaging grooves 36*a* of the sleeve 36 corresponds to the spacing between the adjacent bins B. Thus when the solenoid 48 is de-energized, the forward end 47*a* of the link 47 is automatically brought into engagement with one of the engaging grooves 36*a* of the sleeves 36 by the action of the spring in the solenoid 48. By timing the withdrawing of the forward end 47*a* of the link 47 from the engaging groove 36*a* in such a manner that the withdrawing occurs immediately after the trailing end of the sheet S releases the ejection rollers $R_3$ and $R_4$, it is possible to automatically move the deflecting device 8 downwardly a distance corresponding to the spacing between the bins B each time the sheet S is released from the ejection rollers $R_3$ and $R_4$, to a position corresponding to the next following sheet receiving bin B. In this embodiment, a sensor 76 (See FIG. 6) for sensing release of the trailing end of the sheet S from the ejection rollers $R_3$ and $R_4$ is provided for producing a signal to effect control of energizing and de-energizing the solenoid 48.

When delivery of the sheet S to the lowermost bin B is completed, a condition of sheet distribution set beforehand by the operator is satisfied. Upon the condition being satisfied device raising signal is produced and the solenoid 48 is de-energized in readiness for upward movement of the guiding device 8. The guiding device raising signal disengages the electromagnetic clutch 40, thereby disconnecting the input shaft 41 and output shaft 42. The guiding device raising signal also switches another solenoid 49 on the side plate 18 to an energized condition from a de-energized condition (while the guiding device 8 moves downwardly).

The solenoid 49 has a plunger connected to a link (stopper arm ) 50 moved as the plunger moves in reciprocatory movement. The link 50 is secured by screws at its lower end portion to the periphery of a sleeve 52 of a spring clutch 51 for moving the guiding device 8 upwardly. The spring clutch 51 has an input shaft shown at 52 in FIG. 5 and formed as a unit with a drive sprocket wheel 54. The spring clutch 51 has an output shaft 59 secured to the side plate 18 and prevented from rotation. Idle sprocket wheel 55 and 56 are mounted on the side plate 18 in positions above and below the drive sprocket wheel 65, and an upper run of the chain 31 is trained over the idle sprocket wheel 54, drive sprocket wheel 54 and the idle sprocket 55. The drive sprocket wheel 65 rotates clockwise in FIG. 7 at all times. The spring clutch 51 is constructed such that when the sleeve 52 rotates clockwise in FIG. 7 for a predetermined amount, the input shaft 53 and output shaft 59 are connected together, and when the sleeve 52 rotates counterclockwise, a so-called slip condition occurs and the input shaft 53 and output shaft 59 are disconnected. Upon energization of the solenoid 49, the link 50 causes the sleeve 52 to rotate clockwise, to connect the input shaft 53 and the output shaft 59 together. As aforesaid, the output shaft 59 is secured to the side plate 18 and prevented from rotation, so that the chain 31 is braked by the side plate 18 and the guiding device 8 moves upwardly with the chain 31 while being guided by the guide shaft 12 and the channel $C_1$.

Unless the electromagnetic clutch 40 is provided, the sprocket 43 is meshing engagement with the chain 44 would be forcedly rotated as the guiding device 8 moves upwardly, and rotation of the sprocket 43 would be transmitted through the output shaft 39 to the transmitting member 37. As a result, the spring 38 would be broken. Or if the spring 38 is not broken, the guiding device 8 could not move upwardly. Anyway, the electromagnetic clutch 40 is provided for eliminating such trouble, and it plays an important role because the output shaft 42 and input shaft 41 should be disconnected when the guiding device 8 is moved upwardly. Upon the guiding device 8 reaching the uppermost limit of its movement, a limit switch, not shown, produces a guiding device lowering signal which de-energizes the solenoid 49 and brings the spring clutch 51 to the slip condition. The guiding device lowering signal also engages the electromagnetic clutch 40, and sensing of the trailing end of the sheet S by the sensor energizes the solenoid 48, to allow the guiding device 8 to move downwardly while stopping at positions each corresponding to one of the sheet receiving bins B.

The guiding device 8 has connected thereto a counterbalancing weight 77 (See FIG. 5) so that the weight of the device 8 is substantially zero and downward movement of the device by force of gravity does not occur when it stops during its downward or upward movement.

Referring to FIG. 7, a shaft 67 projects from the side plate 18 in a position midway between the plunger of the solenoid 49 and the spring clutch 51 and has pivotally connected thereto an intermediate portion of an arm 68 having at one end thereof an L-shaped portion **68*a* slidably in contact with an upper inner portion of a stopper arm 50 and having at the other end thereof a cutout portion 69 pivotally movable about a shaft 67 as the solenoid 49 for moving the guiding device 8 upwardly. A shaft 71 extends through the side plate 18 in a position midway between the spring clutch 35 and idle sprocket wheel 46 and rotatably journalled by a bearing 72 (FIG. 5) secured to the mounting plate 19. Secured to an end of the shaft 71 disposed outwardly of the side plate 18 is one end of an arm 70 pivotally engaged at the other end thereof with the cutout portion 68*b* of the arm 68 and urged by the biasing force of a spring 69 to rotate the shaft 71 clockwise in FIG. 7. Secured to an end of the shaft 71 disposed inwardly of the side plate 18 is an arm 73 extending obliquely to a position interposed between the vertical parallel runs of the conveyor belts 7. The arm 73 supports at its forward end the push pin 66 engageable with the cam surface 64*a* of the cam plate 64 of the sheet separating claw 62. In the embodiment shown and described herein, the push pin 66 is in the form of a shaft projecting in the opposite direction as the shaft 71 of the arm 73 and has a roller 75 rotatably mounted thereto (See FIGS. 5 and 8). Thus upon energization of the solenoid 49 for moving the guiding device 8 upwardly the stopper arm 50 is pulled in the direction of an arrow B in FIG. 7, and the arm 68 rotates a predetermined amount clockwise in FIG. 7 about the shaft 67 while its L-shaped portion 68*a* slides along the inner surface of the arm 50 as the latter tilts. The arm 70 causes the shaft 71 to rotate counterclockwise in FIG. 7, and the arm 73 secured to the shaft 71 also rotates counterclockwise in FIG. 7. As a result, the push pin 66 is moved away from the cam surface 64*a* of the sheet separating claw 62**.

With the aforesaid construction, the electromagnetic clutch 40 is engaged and the solenoid 49 for moving the guiding device 8 upwardly is de-energized when the deflecting device 8 is moved downwardly. Then the push pin 66 is maintained in a position in which it is in contact with the cam surface **64*a* of the sheet separating claw 62 and when the guiding device 8 stops in a predetermined position in front of the bin B, the sheet separating claws 62 associated with the bin B are brought to an operative position in which they project beyond the sheet conveying surfaces of teh conveyor belts 7. Thus the sheet S conveyed by the conveyor belts 7 is deflected by the sheet separating claws 62 in the operative position, and ejected by the guide plates 9 and ejecting rollers $R_3$ and $R_4$ on to the sheet receiving bin B. Upon sensing of ejection of the sheet S by a sensor 76, the solenoid 48 for moving the device 8 downwardly energized for a very short period of time, so that the spring clutch 35 is engaged and the drive force of the chain 31 is transmitted to the sprocket 43 which moves downwardly while rotating in meshing engagement with the chain 44, to thereby move the guiding device 8 downwardly. The forward end 47***a* of the link 47 or stopper arm released from engagement with one of the engaging grooves 36*a* of the sleeve 36 when the solenoid 48 is temporarily energized is brought into contact with the periphery of the sleeve 36 as soon as the solenoid 48 is de-energized, and comes into engagement with the next engaging groove 36*a* as the sleeve 36 rotates, to thereby prevent further rotation of the sleeve 36. This disengages the spring clutch 35, and allows the sprocket wheel 34 alone to idly rotate about the shaft 39, so that the guiding device 8 stops in a predetermined position corresponding to the next sheet receiving bin B. As the guiding device 8 moves downwardly, the push pin 66 is released from engagement with the cam surface 64*a* of the cam plate 64 of the sheet separating claw 62 corresponding to the preceding bin B, so that the sheet separating claws 62 are retreated by its own weight to an inoperative position away from the sheet conveying surfaces of the conveyor belts 7.

When the sheets have been distributed to all the bins or to a predetermined number of bins B, a control signal is issued which disengages the electromagnetic clutch 40 and energizes the solenoid 49 for moving the guiding device 8 upwardly. This engages the spring clutch 51 and secures the sprocket wheel 54 to the fixed shaft 59 to prevent its rotation, so that the guiding device 8 moves upwardly as the chain 31 moves upwardly.

As soon as the solenoid 49 for moving the guiding device 8 upwardly is energized, the push pin 66 is moved away from the cam surface 64*a* of the cam plate 64 of the sheet separating claw 62, and collision of the push pin 66 against the cam plate 64 is avoided, so that no noise is produced when the guiding device 8 moves upwardly.

A limit switch, not shown, senses the arrival of the guiding device 8 to a position corresponding to the uppermost bin B and produces a signal which de-energizes the solenoid 49 and disengages the spring clutch 51. Thus the sprocket wheel 54 idly rotates and upward movement of the guiding device 8 is interrupted.

When it is desired to effect maintenance and repair, the operator interrupts supply of a current to the sheet classifying system 1. This disengages the elctromagnetic clutch 40 and spring clutches 35 and 51, to allow the guiding device 8 to be manually moved upwardly and downwardly. In this case, the push pin 66 is disposed in a position in which it is engageable with the cam surface 64*a* of the cam plate 64 of the sheet separating claw 62. However, the cam plate 64 is shaped such that when the push pin 66 moves upwardly the cam plate 64 does not interfere with movement of the push pin 66. Thus the guiding device 8 can be readily moved upwardly or downwardly as desired.

According to the invention, only the sheet deflecting claws 62 required to deflect the sheet S are brought to an operative position with the downward movement of the guiding device 8, and other separating claws are positively brought to inoperative positions so as to minimize the risk of misoperation. When the guiding device 8 is moved upwardly during operation of the sheet classifying system 1, the disadvantages of the prior art that the cam plate and the engaging member for displacing the sheet separating claws produce nose as they are continuously brought into collision and that the service life of the parts is shortened can be eliminated. Since the guiding device 8 can be manually moved after the operator has interrupted the supply of a current to the sheet classifying system, maintenance and repair can be facilitated.

The cam plate of the sheet separating claw for moving the claw to the operative position and inoperative position need not be provided to all the sheet separating claws, and only one cam plate may be provided for one shaft supporting a plurality of sheet separating claws for one sheet receiving bin. Also, the cam plate need not be provided integrally on a side opposite to the sheet guide surface of the claw as described in the embodiment hereinabove, and a cam may be provided as a separate entity independent of the sheet separating claw. In place of the sheet separating claw normally disposed in the inoperating position by its own weight the tension spring for urging the sheet separating claw may be utilized to return to its inoperative position. The chain 44 and sprocket 43 may be replaced by a rack and pinion arrangement.

Figure 13:
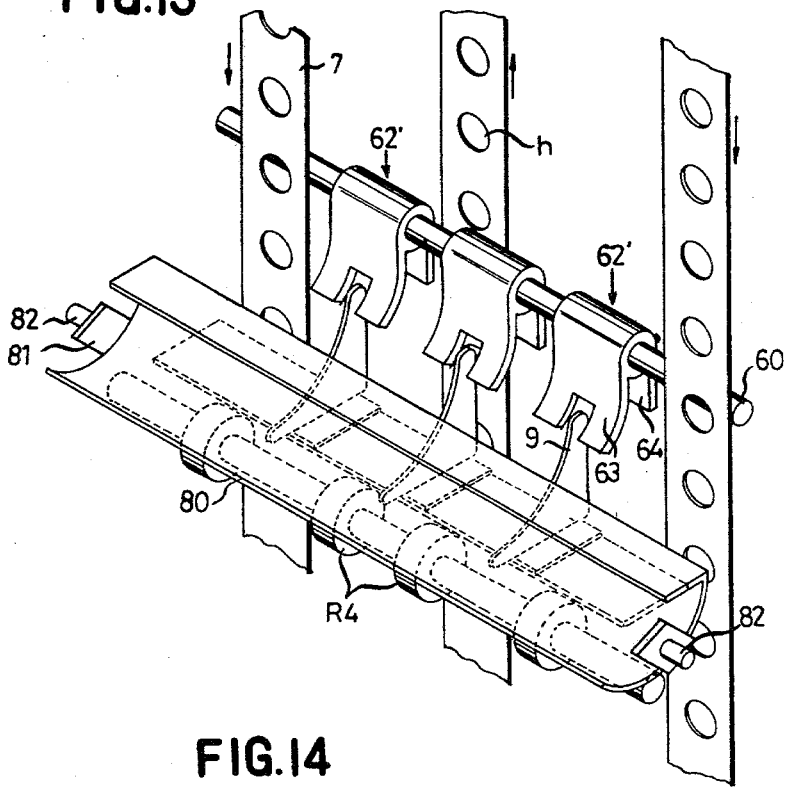
FIG. 13 is a fragmentary perspective view of the sheet classifying system comprising another embodiment of the invention.
Figure 14:
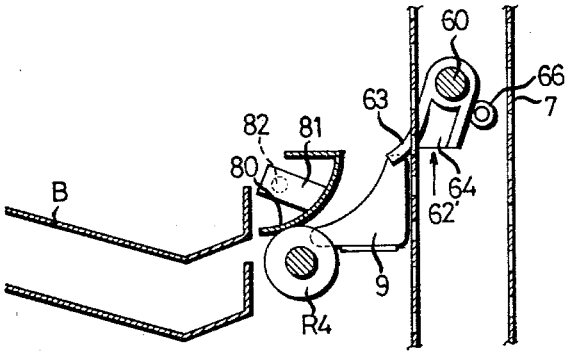
FIG. 14 is a sectional view taken along the conveyor belts shown in FIG. 13.

FIGS. 13 and 14 show another embodiment of the invention which is distinct from the embodiment shown in FIGS. 3–12 in that the upper ejection roller $R_3$ of the deflecting device 8 is done without and instead an upper guide plate 80 having a curved surface substantially of the same size as a quarter circle is in engagement with the lower ejection roller $R_4$ which is formed of a deformable resilient material. As the sheet S separated by the sheet separating claws 62 from the conveyor belts 7 and deflected along the guide plate 9 is introduced between the upper guide plate 80 and the ejection roller $R_4$, the ejection roller $R_4$ is deformed an amount corresponding to the thickness of the sheet S, to allow the sheet S to be nipped and ejected. In this embodiment, the sheet separating claw 62' is of a shape such that the claw plate 63 and the cam plate 64 depend from both sides of the shaft 60. The holes h formed in the conveyor belts 7 are round in shape.

When the need arises to replace the conveyor belts 7 or overhaul and repair the electromagnetic clutch 40 after prolonged service, the sheet classifying system according to the invention can cope with the situation without any trouble. When such need arises, a back cover 57 (See FIG. 3) of the main body of the system is first removed, to expose the sheet guide device 10. Then the screws securing the bent members 15*a* and 15*b* to the main body frame 160 are removed, and the bent members 15*a* and 15*b* are pulled, to pivotally move the sheet guide device 10 and guiding device 8 about the shaft 14.

Then the bracket 21 is detached from the mounting plate 19 together with the roller 22 and push the bent portion 19*b* in the opposite direction, to cause the deflecting device 8 to move in pivotal movement about the shaft 12. Thus the guiding device 8 is spaced apart from the sheet guide device 10. In removing the conveyor belts 7, the belts 7 formed of resilient material can be readily removed from the sheet guide device 10 by expanding same and passing same along the bent member 15*a* which is now a free end. The belts 7 can be mounted by reversing the aforesaid process. Maintenance of the electromagnetic clutch 40 and its associated parts, guide plates 9 and ejection rollers $R_3$ and $R_4$ can be readily effected because direct access can be had to these parts by hand or tool to readily carry out overhaul, repair and replacement. The guiding device 8 and sheet guide device 10 can be restored to their original positions as readily as they are removed therefrom. More specifically, they are moved in pivotal movement in a direction opposite to the direction in which they are moved when removed from their original positions. Then the bracket 21 is mounted on the mounting plate 19 and the bent members 15*a* and 15*b* are screwed in place on the main body frame 160. The time required for the operation is very short.

The rod-shaped guide 83 having a central portion extending forwardly toward the direction in which the sheet S is conveyed and an end portion disposed away therefrom enables the sheet S to be conveyed without any trouble even if the sheet S has developed a curl at its edge. Thus the sheet S can be smoothly conveyed without causing a sheet jam.

The upper guide plate 80 for guiding the sheet S released from the conveyor belts 7 to the ejection rollers $R_3$ and $R_4$ can open and close the sheet passage. Even if a sheet jam occurs, the sheet S can be readily removed from the sheet passage by moving the upper guide plate 80, so that it is possible to cope with the occurrence of a sheet jam promptly.

Maintenance of all the parts of the sheet classifying system can be readily effected. In addition, in the event of the occurrence of a sheet jam in the ejection rollers $R_3$ and $R_4$, lower guide plates 9, etc., the trouble can be readily eliminated.

The sheet classifying system described hereinabove is provided with a plurality of sets of sheet separating claws 62 disposed in positions corresponding to a plurality of sheet receiving bins B, the claws 62 being disposed normally in an inoperative position, and a guiding device 8 including the mechanism for moving the claws to an operative position. The technical concept that the sheet guide device 10 and deflecting device 8 are readily opened and closed, the technical concept of providing the rod-shaped guide 83 for preventing the sheet S from curling at its edge, and the technical concept of moving the upper guide plate 80 to open and close the sheet passage can have application in another type of sheet classifying system.

Referring to FIGS. 15–24, another embodiment of the invention is shown therein in which parts similar to those shown in the embodiment described hereinabove are designated by like reference characters.

Figure 15:
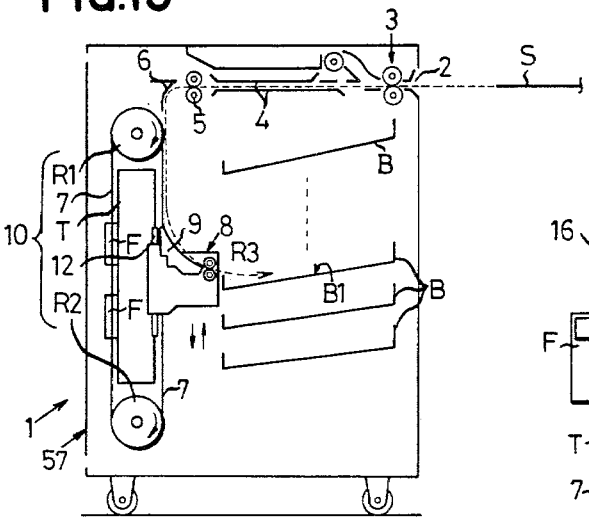
FIG. 15 is a schematic view showing the sheet classifying system comprising still another embodiment of the invention having guide claws disposed on the guiding device side in place of the sheet separating claws.
Figure 18:
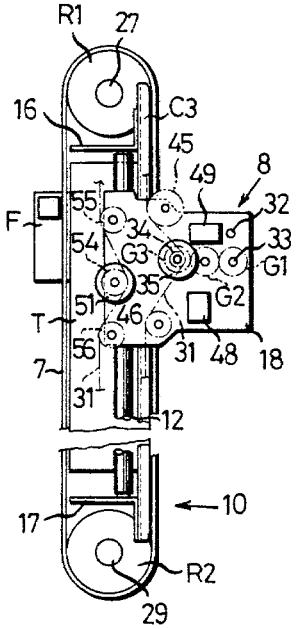
FIG. 18 is one side view of the sheet guide device shown in FIG. 17.

In FIG. 15, the sheet S fed to the sheet classifying system 1 is moved substantially horizontally through the pair of feed rollers 3, pair of guide plates 4 and pair of feed rollers 5 as indicated by a broken line. After having the direction of its movement changed by the direction changing plate 6 from the horizontal to the vertical direction, the sheet S is attracted by the endless conveyor belts 7 arranged vertically for movement in parallel vertical runs and supplied to the deflecting device 8. The sheet S is deflected as it moves along the curved surface of the guide plates 9 built in the guiding device 8, to be delivered to a sheet receiving surface $B_1$ of the bin B.

Figure 16:
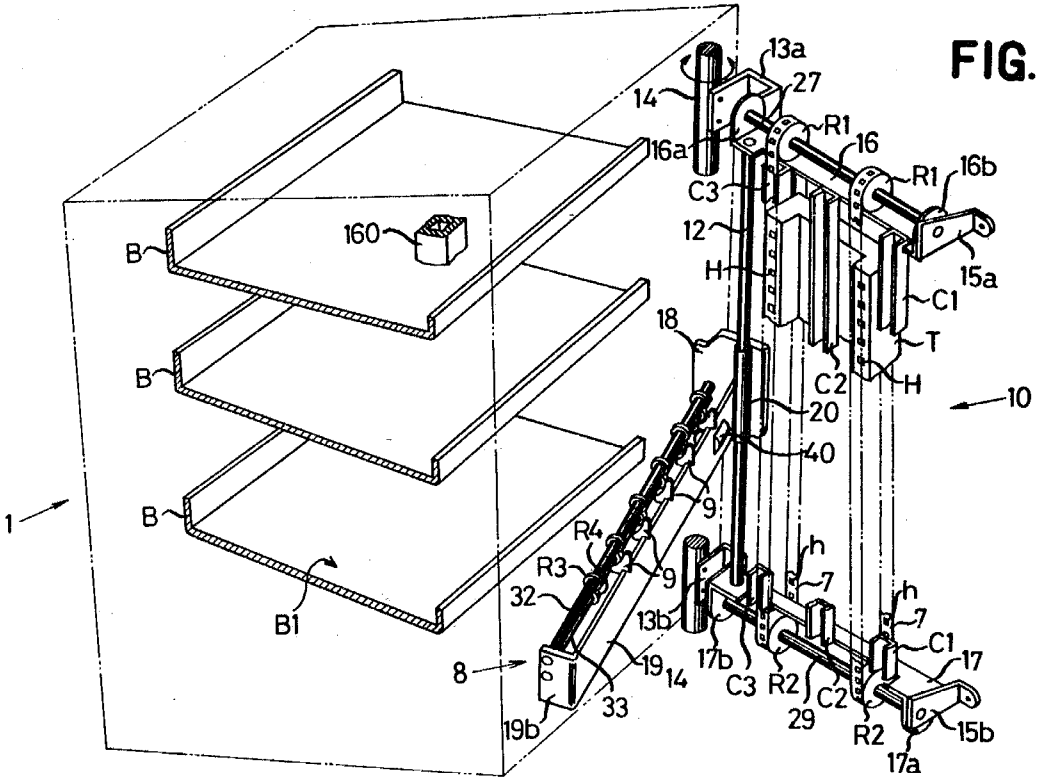
FIG. 16 is a perspective view of the whole of the sheet classifying system with the sheet guide device and the guiding device shown in FIG. 15 being exposed.
Figure 20:
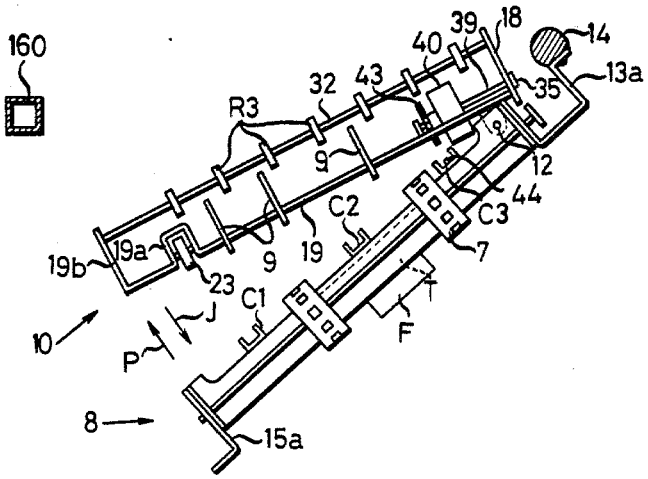
FIG. 20 is a fragmentary plan view of the system shown in FIG. 16.
Figure 21:
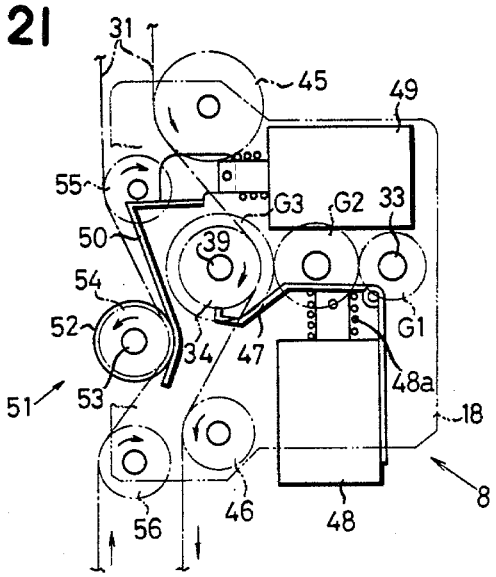
FIG. 21 is a side view of the guiding device.

Referring to FIG. 16, the sheet guide device 10 includes substantially U-shaped bent members 13*a* and 13*b* attached to one side thereof and secured to opposite ends of the vertically extending shaft 14 pivotally connected to the main body of the sheet classifying system 1. Thus the sheet guide device 10 can be moved in pivotal movement about the shaft 14, as shown in FIGS. 16 and 20. Meanwhile the sheet guide device 10 also includes substantially L-shaped bent members 15*a* and 15*b* attached to the other side thereof. When in closed position, the sheet guide device 10 is screwed to the main frame 160 of the system as described by referring to FIG. 15, to allow a sheet classifying operation to be carried out.

The U-shaped bent member 13*a* and the L-shaped bent member 15*a* are secured to the bent portions 16*a* and 16*b* formed at opposite ends of the upper support member 16 respectively. Likewise, the U-shaped bent member 13*b* and the L-shaped bent member 15*b* are secured to the bent portions 17*a* and 17*b* at opposite ends of the lower support member 17 respectively (See FIG. 17). The shaft 12 supporting the guiding device 8 is secured to a portion of the upper support member 16 near the bent portion 16*a* and a portion of the support member 17 near the bent portion 17*b* of the lower support member 17. The deflecting device 8 comprises the side plate 18, the mounting plate 19 secured at one end thereof to the side plate 18 and extending longitudinally of the upper support member 16 when assembled, and various parts secured to the side plate 18 and mounting plate 19. The mounting plate 19 on a portion thereof near the side plate 18 the bearing 20 for slidably supporting the shaft 12.

Figure 19:
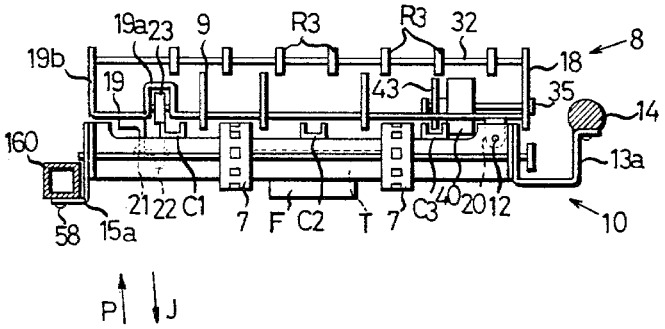
FIG. 19 is a top plan view of the sheet guide device shown in FIG. 17.
Figure 17:
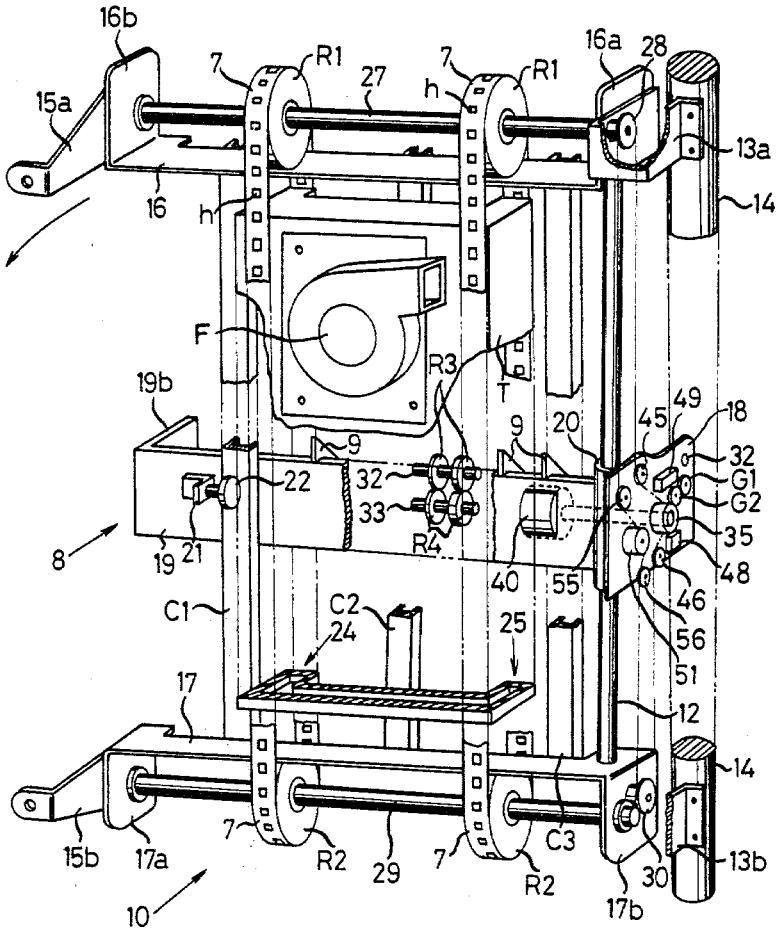
FIG. 17 is a perspective view of the sheet guide device.

The bracket 21 is detachably mounted on the other end of the mounting plate 19 and supports the roller 22 (See FIGS. 17 and 19). The roller 22 is disposed against the back of the channel $C_1$ which is one of the channels $C_1$, $C_2$ and $C_3$ secured between the upper and lower support members 16 and 17 as the bracket 21 is mounted.

As shown in FIG. 19, the roller 23 is disposed in a position corresponding to the roller 22 with the channel $C_1$ being interposed therebetween. The roller 23 is journalled by a bearing 19*a* formed by bending a portion of the mounting plate 19. The rollers 22 and 23 are maintained in light touch with the channel $C_1$ and perform the function, together with the bearing 20, of guiding the guiding device 8 as the latter moves vertically.

The vacuum tank T is secured between the upper and lower support members 16 and 17 by utilizing the channel $C_2$ extending therebetween. The sheet S having the direction of its movement changed by the direction changing plate 6 from the horizontal to the downward direction is attracted to the conveyor belts 7 by the action of the vacuum tank T, so that the sheet S can be moved downwardly along the conveyor belts 7 without dropping by the force of gravity until it reaches the guiding device 8. Bent end edges of the channels $C_1$, $C_2$ and $C_3$ are disposed at the same level as the projecting surfaces 24 and 25 of the tank T, so as to support the sheet S at a plurality of points and keep same in planar condition by avoiding bending of same when moved downwardly.

Figure 22:
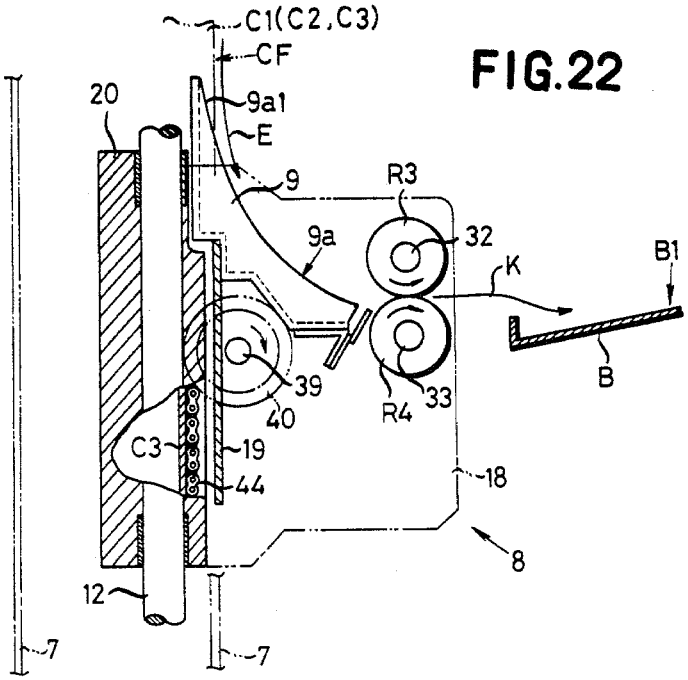
FIG. 22 is a fragmentary sectional view of the guiding device.
Figure 23:
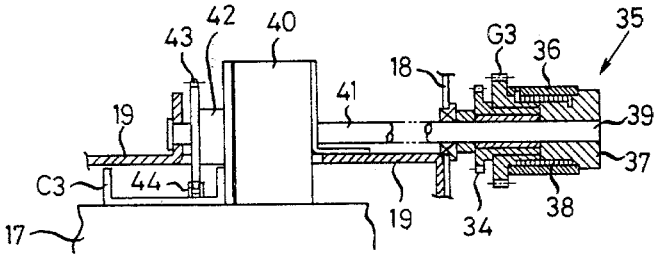
FIG. 23 is a fragmentary sectional view of the spring clutch and electromagnetic clutch for moving the guiding device downwardly and their neighborhood.

The construction of the deflecting device 8 will now be described. A plurality of guide claws 9 are mounted in spaced relation on the mounting plate 19 and disposed upright. As shown in FIG. 22, an upper starting end portion 9*a*1 of a curved surface 9*a* of each guide claw 9 is disposed below a belt end surface CF of the channel $C_1'$ ($C_2$ and $C_3$). By this arrangement, the sheet S moving downwardly by being guided by the bent end surface CF is smoothly transferred to the curved surface 9*a* and deflected in the direction of an arrow E while moving along the curved surface 9*a*, to be nipped by the ejection rollers $R_3$ and $R_4$ rotating in contact with each other, so that the sheet S can be ejected in the direction of an arrow K. A sheet receiving bin B is disposed in the direction of the arrow K, so that the sheet S is delivered substantially parallel to the sheet receiving surface $B_1$ of the bin B.

The output shaft 39 of the spring clutch 35 is connected to the input shaft 41 of the electromagnetic clutch 40 mounted on the mounting plate 19, and the output shaft 42 of the electromagnetic clutch 40 is secured to a sprocket wheel 43'. A chain 44' is secured to a recess in the channel $C_3$ and extends vertically, the chain 44' being trained over the sprocket wheel 43' (See FIGS. 22 and 23).

When the solenoid 48 is de-energized, the forward end of the link 47 is caused by a spring 48*a* to press against the periphery of the sleeve 36 and engage one of the link engaging grooves, to prevent rotation of the sleeve 36. When the solenoid 48 is energized, the plunger of the solenoid 48 is moved downwardly against the biasing force of the spring 48*a*, so that the link 47 is released from engagement with the link engaging groove on the periphery of the sleeve 36, to allow the sleeve 36 to rotate freely.

Assume that the electromagnetic clutch 40 is engaged. The guiding device 8 itself begins to move downwardly while being guided by the shaft 12 and channel $C_3$ with respect to the chain 44' secured to the channel $C_3$. The downward movement of the deflecting device 8 can be interrupted by de-energizing the solenoid 48. By controlling the operation of the solenoid 48 by energizing and de-energizing same as desired, the guiding device 8 can be moved downward intermittently.

Upon completion of the delivery of the sheet S to the lowermost bin B, a deflecting device raising signal is generated, and the solenoid 48 is de-energized in preparation for moving the guiding device 8 upwardly. The deflecting device raising signal disengages the electromagnetic clutch 40, thereby disconnecting the input shaft 41 and output shaft 42. The deflecting device raising signal also energizes the solenoid 49 mounted on the side plate 18 for moving the guiding device 8 upwardly which has remained de-energized while the guiding device 8 is being moved downwardly. The solenoid 49 has a plunger connected to the link (stopper arm) 50.

Idle sprocket wheels 55 and 56 are mounted on the side plate 18 in positions above and below the drive sprocket wheel 54 respectively. A normally upper run of the chain 31 is trained over the idle sprocket wheel 56, drive sprocket wheel 54 and idle sprocket wheel 55 in the indicated order. The drive sprocket wheel 54 is urged to rotate counterclockwise in FIG. 21 at all times. As the solenoid 49 is energized, the link 50 causes the sleeve 52 to rotate clockwise, to connect the input shaft and the output shaft of the spring clutch 45 together. Thus the guiding device 8 is guided by the shaft 12 and channel $C_1$ in its upward movement with the chain 31. Upon the guiding device 8 reaching the uppermost end of its travel, a limit switch detects its arrival at the uppermost end and produces a deflecting device lowering signal.

Removal of the back cover 57 (See FIG. 15) of the sheet classifying system main body exposes the sheet guide device 10 as shown in FIG. 19. Screws 58 securing the bent members 15*a* and 15*b* to the main body frame 160 are moved, and the bent members 15*a* and 15*b* are held by hand and moved in the direction of an arrow J. The sheet guide device 10 and the guiding device 8 are pivotally moved about the shaft 14, to an open position.

Then the bracket 21 is removed from the mounting plate 19 together with the roller 22, and the bent portion 19*b* is pushed in the direction of an arrow P opposite to the direction of the arrow J. This moves the guiding device 8 in pivotal movement about the shaft 12, to bring same into spaced relation to the sheet guide device 10. FIGS. 16 and 20 show the results of these operations.

Figure 24:
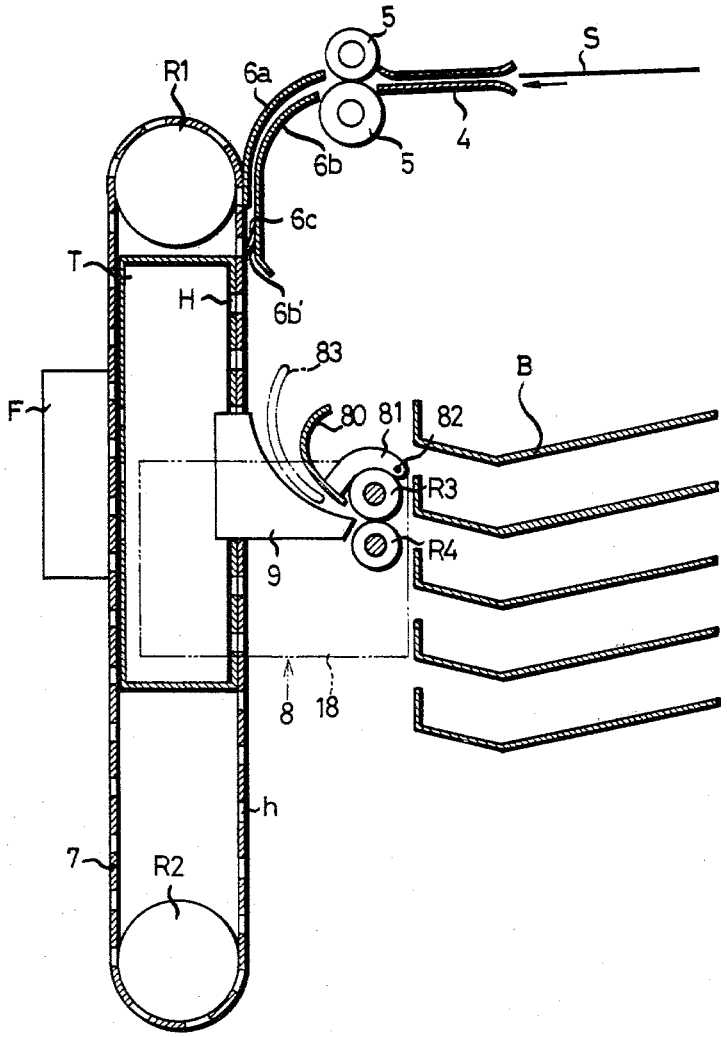
FIG. 24 is a view showing in detail the arrangement of the upper guide plate and the rod-shaped guide member in relation to the guide claws of the guiding device shown in FIG. 15.

FIG. 24 shows a modification in which the upper guide plate 80 can be pivotally moved about the shaft 82 relative to the guide claw 9. FIG. 24 also shows the rod-shaped guide 83 in phantom. The upper guide 80 and the rod-shaped guide 83 are described by referring to FIGS. 9–14 and no additional description will be required.

What is claimed is:

1. A sheet classifying system comprising:

a plurality of sheet receiving bins superposed one above another in predetermined spacing relationship;

a sheet guide device including sheet conveyor belts arranged vertically along an inlet end of said sheet receiving bins;

a plurality of sets of sheet separating claws located in a plurality of layers along said sheet conveyor belts and each set being disposed in a position corresponding to one of said sheet receiving bins; and a guiding device moved vertically by said sheet guide device along said sheet conveyor belts, vertical movement of said guiding device successively bringing said plurality of sets of sheet separating claws to an operative position for deflecting sheets conveyed by said conveyor belts toward the respective sheet receiving bins, to be received therein; wherein the improvement comprises:

a plurality of cams operating as a unit with the sheet separating claws for displacing the sheet separating claws, at least one of said cams being associated with one set of said sheet separating claws;

engaging means mounted in said guiding device and operative to come into and out of engagement with said cams for moving said sheet separating claws between an operative position and an inoperative position;

sheet separating claw returning means urging said sheet separating claws to move toward said inoperative position at all times;

a mechanism for upwardly moving said guiding device;

a solenoid for actuating said mechanism for moving said guiding device upwardly;

said engaging means being in engagement with one of said cams for displacing said sheet separating claws; and said solenoid being operative to actuate said mechanism for upwardly moving said guiding device and keep said engaging means in a position away from the position in which it is in engagement with said sheet separating claw displacing cam.

2. A sheet classifying system as claimed in claim 1, wherein said guiding device and said sheet guide device can be pivotally moved about one end of a main body of the sheet classifying system, and said guiding device can be pivotally moved about one end of said sheet guide device.

3. A sheet classifying system as claimed in claim 1, or 2, wherein said sheet guide device further comprises a vacuum tank of a size extending at least along the extent of the sheet receiving bins arranged vertically in a plurality of layers, and said sheet conveyor belts move in parallel vertical runs surrounding said vacuum tank.

4. A sheet separating system as claimed in claim 1 or 2, wherein said guiding device comprises a pair of ejection rollers disposed at an inlet end of said bins and supported by said guiding device, guide means for guiding a sheet separated from said conveyor belts by said sheet separating claws to be transferred to said ejection rollers, and a rod-shaped guide interposed between upper and lower guide plates of said guide means and secured to one end of said guiding device, said rod-shaped guide being shaped such that its central portion extends toward the direction in which each sheet is conveyed and its end portion is away from said direction.

5. A sheet classifying system as claimed in claim 4, wherein said upper guide plate of said guide means for guiding a sheet separated from said conveyor belts by said sheet separating claws to be transferred to said ejection rollers can be moved to open or close a sheet passage forming a part of said guiding device.

* * * * *